US005403167A

United States Patent [19]

Kobayashi et al.

[11] Patent Number: 5,403,167

[45] Date of Patent: Apr. 4, 1995

[54] STRUCTURE OF LIQUEFIELD HYDROGEN PUMP

[75] Inventors: Kazumitsu Kobayashi, Atsugi; Shoichi Furuhama; Kimitaka Yamane, both of Tokyo, all of Japan

[73] Assignees: Unisia Jecs Corporation, Atsugi; Gotoh Ikueikai, Tokyo, both of Japan

[21] Appl. No.: 152,495

[22] Filed: Nov. 16, 1993

[30] Foreign Application Priority Data

Nov. 16, 1992 [JP] Japan ..... 4-330101

[51] Int. Cl.[6] ..... F01B 19/02

[52] U.S. Cl. ..... 417/461; 417/547; 417/552; 92/118

[58] Field of Search ..... 417/460, 461, 547, 552; 92/118

[56] References Cited

U.S. PATENT DOCUMENTS

| | | | |
|---|---|---|---|
| 2,552,778 | 5/1951 | French | 417/460 |
| 2,901,980 | 9/1959 | Jordan | 417/547 |
| 3,162,143 | 12/1964 | Ferguson | 417/460 |
| 3,168,014 | 2/1965 | Aslan | 92/118 |

OTHER PUBLICATIONS

Yamane et al., "A Study On The Structure Of Liquid Hydrogen Pump", Hydrogen Energy Association, Nov. 17, 1992, vol. 17, No. 3 pp. 24–30.

*Primary Examiner*—Richard A. Bertsch
*Assistant Examiner*—Xuan M. Taai
*Attorney, Agent, or Firm*—Foley & Lardner

[57] ABSTRACT

The invention relates to a structure of a liquefied hydrogen pump, located within a liquefied hydrogen fuel tank of a hydrogen (gas ignited) engine, in which a cylinder holder is linked to a lower end of the connecting rod which is reciprocated upwardly and downwardly by means of an external driving source via a first universal joint and a cylinder is housed within a piston holding member via each arm of the cylinder holder so as to be enabled to move upwardly and downwardly. A stepped engagement recess is formed in a bottom end portion of a pump housing. A bottom lid of the piston holding member is linked to an engagement rod via a second universal joint, the engagement rod being received by the engagement recess so that a radial displacement of the piston holding member and piston member to the pump housing is permitted and an automatic axial alignment of both piston and cylinder to an axial line 01—01 of the pump housing is carried out.

12 Claims, 6 Drawing Sheets

STRUCTURE OF LIQUEFIELD HYDROGEN PUMP

BACKGROUND OF THE INVENTION

1. Field of The Invention

The present invention relates to a structure of liquefied hydrogen pump suitable for use in discharging and supplying, for example, hydrogen liquefied under an extremely low temperature in a fuel tank to a hydrogen (ignited) engine.

2. Description of The Background Art

A previously proposed structure of a liquefied hydrogen pump used in a fuel supply apparatus for a hydrogen ignited engine will be explained below.

A hydrogen fuel tank is installed to reserve the liquefied hydrogen. The hydrogen fuel tank is formed with a so-called double wall structure made of heat insulating materials (adiabatic materials). A vacuum layer is formed between the two heat insulating walls. In addition, the liquefied hydrogen having a volume of approximately 100 liters is contained under a pressure of a range from approximately 0.05 MPa (Mega Pascal) to approximately 0.1 MPa.

In the fuel supply apparatus described above, a liquefied hydrogen pump is formed in a cylindrical shape with a bottom. The previously proposed liquefied hydrogen pump generally includes: an elongated pump housing vertically extended from an upper end toward a lower end; a cylinder fixedly secured around an inner periphery of the lower end of the pump housing; a piston slidably inserted and fitted into the cylinder, the piston reciprocating upward and downward within the cylinder; and a pump head projected externally from the tank.

The pump head includes a crankshaft rotatably driven via a belt wheel by means of an external DC motor; a cross head which reciprocates upward and downward within the pump head, the cross head being linked to the crankshaft via a connecting rod; and another connecting rod, located at a lower end of the cross head, formed in an elongated rod shape having a small diameter, and which reciprocates the piston in synchronization with the cross head within the cylinder.

A suction tube is, furthermore, provided at the bottom portion of the pump housing so as to communicate with the hydrogen fuel tank via a suction valve.

A discharge tube is disposed such that one end thereof is communicated with a discharge valve provided within the piston and the other end thereof is extended externally from the pump head. The discharge tube is vertically extended.

When the piston within the cylinder is reciprocated in the hydrogen fuel pump, the liquefied hydrogen within the hydrogen fuel tank is sucked from the suction tube via the suction valve so that the liquefied hydrogen is discharged externally from the suction tube under a pressure of, for example, approximately 10 MPa.

Next, a heat exchanger is interposed between a tip end of the discharge tube and engine body (to be described later). The heat exchanger is supplied with a hot water or so forth from an external equipment in order to heat the liquefied hydrogen discharged from the discharge tube so as to vaporize the liquefied hydrogen into hydrogen gas. The heat exchanger supplied the vaporized hydrogen gas by means of the hot water and so forth to a hydrogen injection valve via a supply tube located downstream of the heat exchanger.

A surge tank is provided in a midway through the supply tube. The surge tank contains the vaporized hydrogen gas at a normal temperature under a pressure of, for example, approximately 10 MPa so as to prevent pulsations in the hydrogen gas when the hydrogen gas is injected from the hydrogen injection valve.

The engine body is so-called hydrogen ignited engine. The hydrogen ignited engine generally includes: a piston which is reciprocated within a cylinder; and a cylinder head disposed above the cylinder so as to define a combustion chamber between the piston and cylinder. The cylinder head is provided with an ignition plug projected into the combustion chamber. The ignition plug ignites the hydrogen gas injected from the hydrogen injection valve within the combustion chamber so that a combustion pressure of the hydrogen gas is generated within the cylinder.

The hydrogen engine includes the hydrogen injection valve described above. The hydrogen injection valve is disposed in the cylinder head. The hydrogen injection valve includes a plunger which serves to open a valve body against a spring force of a valve spring so that the hydrogen gas from the supply tube is injected into the combustion chamber. It is noted that the plunger of the hydrogen injection valve is driven in its open direction under the instantaneous pressure when a high pressurized oil (hydraulic) is supplied via a distribution tube, for example, by means of, a fuel injection pump for a Diesel engine. Then, when the high pressurized oil is exhausted into a reservoir via a distribution tube, the valve spring serves to push the valve body toward its close direction.

When the crankshaft of the liquefied hydrogen pump is rotated via the belt wheel, the cross head is reciprocated within the pump head so that the piston linked to the cross head via the elongated connecting rod is reciprocated within the cylinder. The liquid hydrogen within the hydrogen fuel tank is sucked into the cylinder from the suction tube and discharged via the discharge tube. Then, the liquefied hydrogen discharged within the discharge tube is vaporized into the hydrogen gas by means of the heat exchanger. The vaporized hydrogen gas is supplied from the supply tube to the hydrogen injection valve via the surge tank.

In the hydrogen injection valve, the high pressurized oil from the injection pump causes the plunger to be driven so that the valve body is open against the spring force of the valve spring. During the open state of the valve body, the hydrogen gas having a pressure of approximately 10 MPa is injected into the combustion chamber of the hydrogen ignited engine. Then, the hydrogen ignited engine mixes the injected hydrogen gas with a suction air and ignites and burns the air-hydrogen mixture so that the generated combustion pressure causes the piston to be driven, thus generating a revolution output from its crankshaft.

Since, in the previously proposed fuel supply apparatus described above, the liquefied hydrogen is contained at the extremely low temperature of approximately −253° C. under a pressure ranging from approximately 0.05 MPa to approximately 0.1 MPa and the liquefied hydrogen is discharged by means of the liquefied hydrogen pump into the discharge tube under the pressure of approximately 10 MPa, it is necessary to form (elongate) the connecting rod linking the piston and cross head in an elongated rod.

However, a large compressive weight is acted upon the elongated connecting rod described above when the liquefied hydrogen under a low pressure is pressurized up to, for example, approximately 10 MPa by means of the piston of the liquefied hydrogen pump. Consequently, such a trouble as a seating and flexing of the elongated rod would be easy to occur.

In addition, it is difficult for the piston linked to the cross head via the elongated connecting rod to be coaxially disposed within the cylinder. If the piston within the cylinder were slightly inclined with respect to the cylinder, a frictional heat would occur between the piston and cylinder during the slide motion of the piston. In worst case, the frictional heat causes the liquefied hydrogen to become easy to be vaporized so that it becomes difficult to maintain the internal of the hydrogen tank at the extremely low temperature.

SUMMARY OF THE INVENTION

It is, therefore, a principal object of the present invention to provide an improved structure of a liquefied hydrogen pump which can automatically make coaxial alignment of the piston to the cylinder, can prevent such a frictional heat between these elements of the pump, and can assure the improvement of discharging efficiency of the liquefied hydrogen.

The above-described object can be achieved by providing a structure of a liquefied hydrogen pump, comprising; a) a cylindrical pump housing having a bottom end portion thereof, said bottom end portion having an inlet which is so constructed to suck a liquefied hydrogen in a liquefied hydrogen fuel tank into an inside of the pump housing; b) a pump driving portion located on a top portion of the pump housing and which is so constructed as to be reciprocated by means of an external drive source; c) an elongated connecting rod, a top end thereof being linked to said pump driving portion, which is extended within said pump housing and along an axial direction of the pump housing; d) a first universal joint; e) a cylinder member swingingly linked to a lower end of said connecting rod via said first universal joint and which is so constructed as to reciprocate within said pump housing according to the reciprocating motion of said pump driving portion; f) a piston member slidably fitted into an inside of said cylinder member and which is so constructed as to make a relative displacement to said cylinder member so that the liquefied hydrogen sucked via said inlet is discharged toward an external of said pump housing; g) a second universal joint; h) a piston holding member, a top end portion thereof being secured to said piston member and a lower end portion thereof being swingingly linked to the bottom end portion of said pump housing via said second universal joint; and i) displacement correcting means for permitting said piston holding member to be displaced toward a radial direction of the pump housing and for limiting said piston holding member to be displaced toward the axial direction of the pump housing.

DESCRIPTION OF THE PREFERRED EMBODIMENT

Reference will hereinafter be made to the drawings in order to facilitate a better understanding of the present invention.

A liquefied hydrogen pump is placed on a side of a liquefied hydrogen tank as described in the BACKGROUND OF THE INVENTION.

FIG. 1 through FIG. 5 show the liquefied hydrogen pump in a preferred embodiment according to the present invention.

Figure 1:
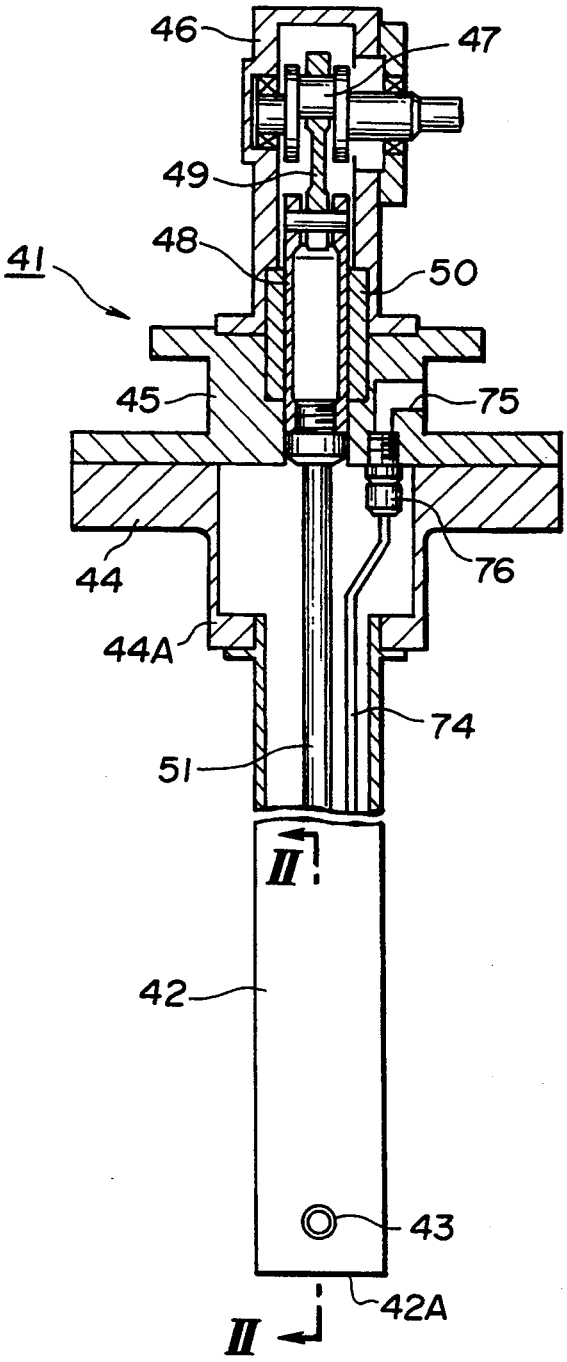
FIG. 1 is an elevational partially cross sectioned view of a liquefied hydrogen pump in a preferred embodiment of a structure of a liquefied hydrogen pump according to the present invention.

In FIG. 1, the whole liquefied hydrogen pump 41 is shown.

A pump housing denoted by reference numeral 42 is formed in a cylindrical shape with a bottom portion, an elongated direction thereof having the approximately same height as the pump housing explained in the BACKGROUND OF THE INVENTION.

Generally, the pump housing 42 shown in FIG. 1 is disposed vertically within the liquefied hydrogen fuel tank explained in the BACKGROUND OF THE INVENTION.

Figure 2:
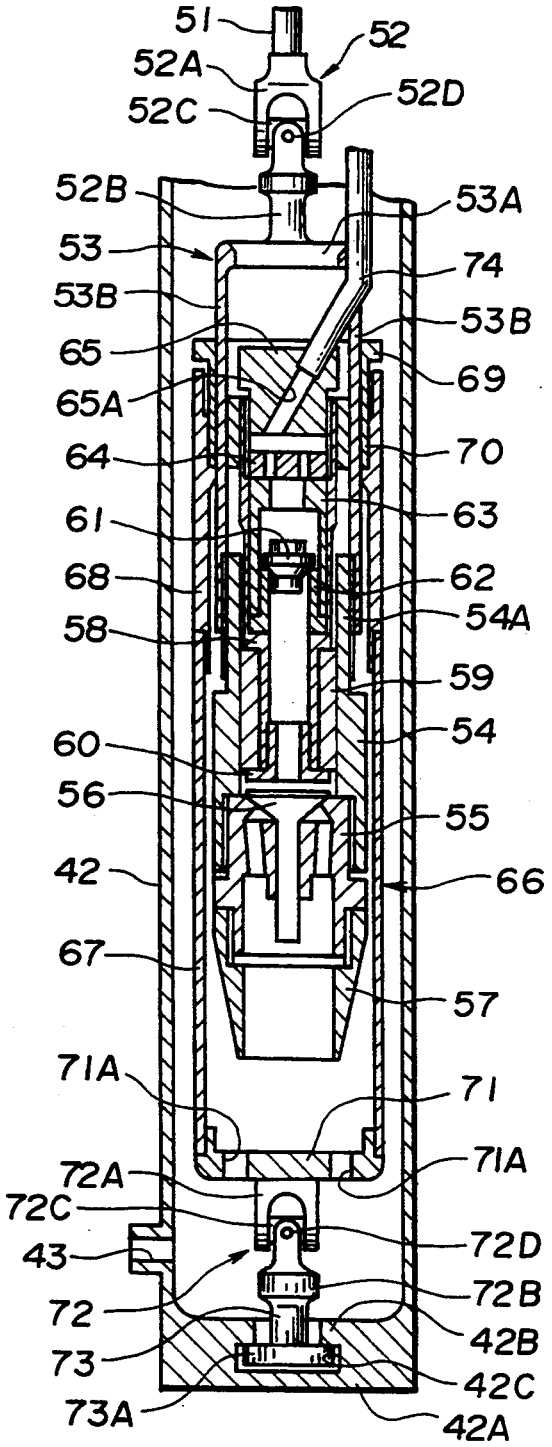
FIG. 2 is an enlarged cross sectional view of a lower part of the liquefied hydrogen pump cut away along the line II—II of FIG. 1.

As shown in FIGS. 1 and 2, a suction inlet 43 is projected radially from a side wall of the bottom portion 42A of the pump housing 42. It is noted that the suction inlet 43 is connected with a suction tube whose end is exposed at an internal of the bottom portion of the liquefied hydrogen fuel tank explained in the BACKGROUND OF THE INVENTION.

In addition, as shown in FIG. 2, a stepped engagement recess 42C is formed on a center of the bottom end portion 42A of the pump housing 42. The stepped engagement recess 42C is provided with a ring-shaped step portion 42B. It is noted that an engagement rod 73 (as will be described later) is engaged with the stepped engagement recess 42C so as to permit a displacement of the engagement rod 73 in a radial direction of the housing.

A first mounting flange 44 is disposed on the upper portion of the pump housing 42. The first mounting flange 44 is of a cylindrical shape with its bottom portion. A second mounting flange 45 is disposed on the upper portion of the pump housing 42 so as to be fitted to the first mounting flange. Both of the first and second mounting flanges are integrally mounted on an upper end portion of the liquefied hydrogen fuel tank with fastening means such as a bolt so that the pump housing is positioned within the liquefied hydrogen tank in a vertically suspended form.

As shown in FIGS. 1 and 2, an outer periphery of the upper end portion of the pump housing 42 is fitted into and secured to a center portion of the bottom portion 44A of the first mounting flange 44. The first and second mounting flanges 44 and 45 serve to communicate an internal portion of the pump housing 42 with a pump head 46 (as will be described below).

The pump head 46 is disposed coaxially on the second mounting flange 45. It is noted that the pump head 46 is projected externally from the liquefied hydrogen fuel tank in the same way as the pump head as described in the BACKGROUND OF THE INVENTION.

(Therefore, the previously proposed hydrogen fuel supply apparatus explained in the BACKGROUND OF THE INVENTION except the liquefied hydrogen pump is herein incorporated by reference).

A crankshaft 47 is rotatably installed within the pump head 46. Then, the crankshaft 47 is rotatably driven via a belt wheel (not shown in FIGS. 1 through 5 but explained in the BACKGROUND OF THE INVENTION) by means of a DC motor (not shown) which serves as an external drive source. Thus, a cross head 48 is reciprocated upwardly and downwardly via a connecting rod 49 within a pump head 46. It is noted that the cross head 48 constitutes a pump drive portion together with the crankshaft 47 and is inserted and fitted into the pump head and second mounting flange 45 via a liner 50 so as to be enabled to make a slide motion therein.

An upper end of an elongated connecting rod 51 is linked to the cross head 48. The elongated connecting rod 51 is formed in the elongated rod shape made of a high rigidity material such as a stainless steel or so forth. Its lower end of the connecting rod 51 is linked to a cylinder 54 (as will be described later). The connecting rod 51 is driven upwardly and downwardly together with the cross head 48 so that a cylinder 54 is relatively reciprocated with respect to a piston 58 (as will be described later).

A first universal joint 52 is installed on a lower end of the connecting rod 51. The first universal joint 52 is pivotally jointed between upper and lower joint rods 52A and 52B via mutually orthogonal pins 52C and 52D. A lower end of the Joint rod is secured to a cylinder holder 53 (as will be described later). The first universal joint 52 permits the cylinder holder 53 to be inclined to a forward, rearward, left, and right directions within the pump housing 42 with respect to the connecting rod 51 and to be swung so that the cylinder holder 53 is driven upwardly or downwardly by means of the connecting rod 51.

The cylinder holder 53 is linked to the lower end of the connecting rod 51 via the first universal joint 52.

Figure 4:
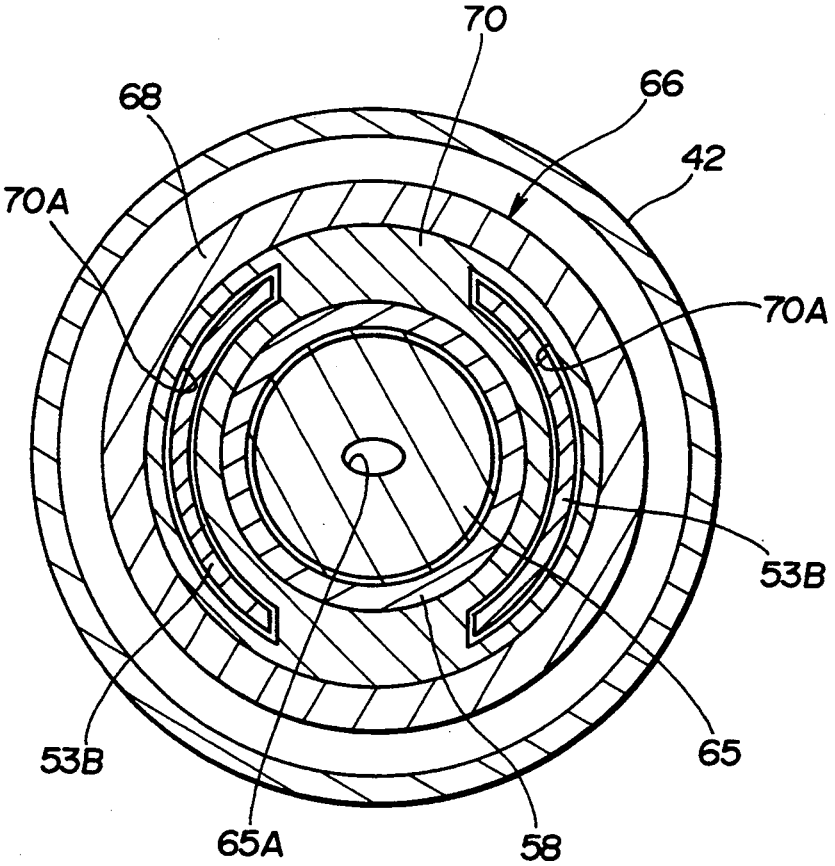
FIG. 4 is an enlarged cross sectional view of the liquefied hydrogen pump cut away along the line IV—IV of FIG. 3.

As shown in FIG. 2, the cylinder holder 53 includes: a linkage portion 53A having a disc shape and secured to the Joint rod 52B of the first universal joint 52; and a pair of arms 53B, 53B extended downwardly from an outer periphery of the linkage portion 53A so as to oppose each other in its right and left directions and formed in an arc shape of a cross section as shown in FIG. 4.

Each arm 53B is inserted and penetrated within the piston holder 66 via each penetrating hole 70A of the piston holder 66 (as will be described later).

Figure 3:
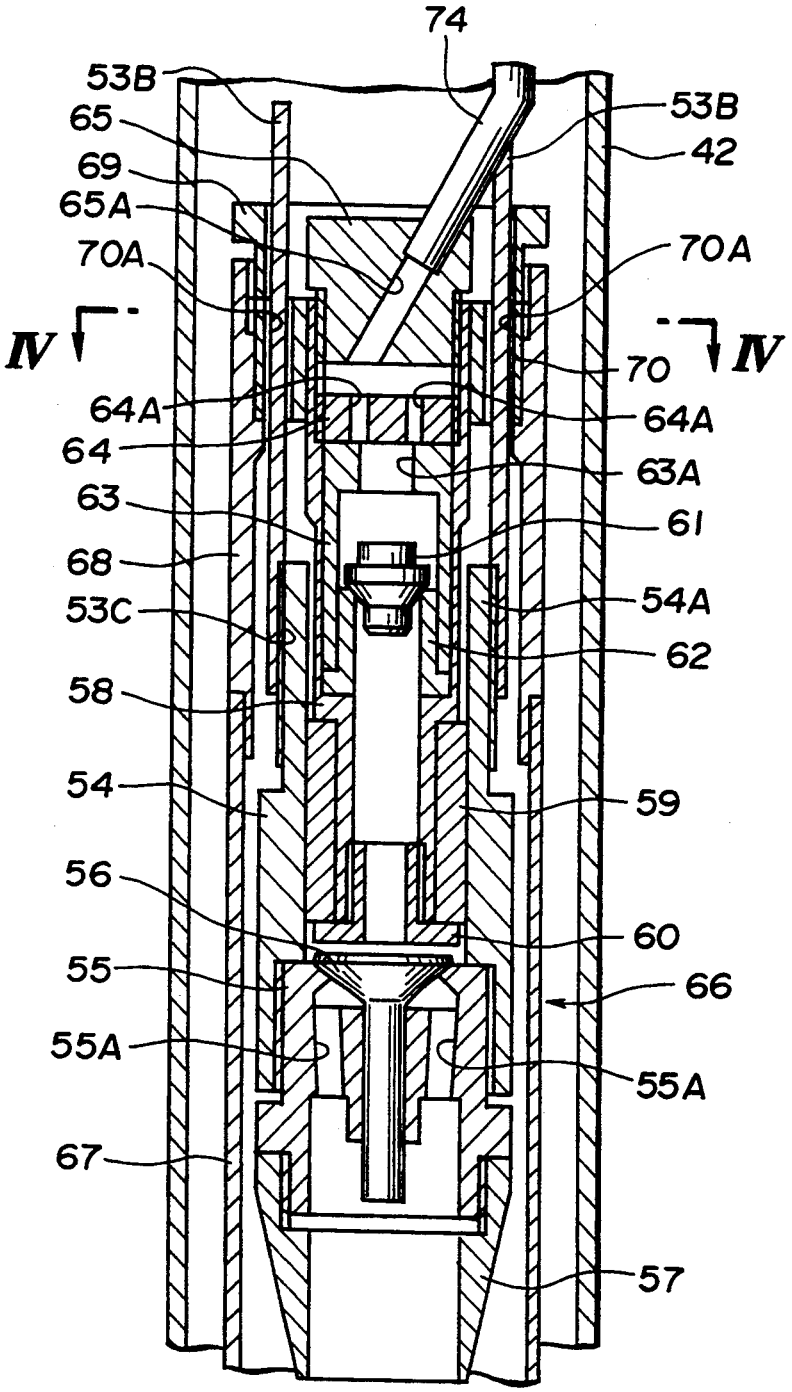
FIG. 3 is an enlarged cross sectional view of an essential part of the liquefied hydrogen pump shown in FIGS. 1 and 2.

A female screw 53C is formed on a lower end of each arm 53B. The female screw 53C is spirally secured to the cylinder 54 as shown in FIG. 3.

The cylinder 54 is housed within the piston holder 66 via each arm 53B so as to permit its upward and downward motion, the cylinder 54 being formed in a stepped cylindrical shape made of a high rigidity metallic material such as a stainless steel. An upper end of the cylinder 54 constitutes a male screw portion 54A spirally engaged with the female screw portion 53C of the cylinder holder 53. In addition, a cylindrical valve seat member 55 is spirally secured to an inner periphery of the lower end of the cylinder 54. A suction valve 56 is attached onto the valve seat member 55 so as to be enabled to open and close the suction valve 56.

Passages 55A, 55A, — of the liquefied hydrogen are formed around the suction valve 56 so that each passage 55A can communicate the liquefied hydrogen in the tank within the piston 58 when the suction valve 56 is open.

A tapered envelope 57 is spirally secured to the outer periphery of the lower end of the valve seat member 55. As shown in FIG. 2, the tapered envelope 57 is formed so that its diameter is gradually reduced as the lowest end comes. Thus, when the valve member 55 is moved upwardly and downwardly together with the cylinder 54 within the piston holder 66, the liquefied hydrogen within the piston holder 66 can be prevented from being stirred.

The piston 58 is formed in a stepped cylindrical shape made of the metallic material such as a stainless steel. The piston 58 is inserted and fitted into the cylinder 54 via a ring 59 so as to enable its slide motion. It is noted that an axial displacement of the piston 58 is limited by means of the piston holder 66 within the pump housing 42. A ring press 60 of a cylindrical shape is spirally secured to the lower end of the piston 58. The ring press 60 fixes a cylindrical ring 59 to an outer peripheral side of the piston 58. When the cylinder 54 is moved upwardly and downwardly within the pump housing 42, the piston 58 relatively reciprocates to the cylinder 54 therewithin so that the liquefied hydrogen sucked via the suction valve 56 is discharged from a discharge valve 61 (as will be described below).

The discharge valve 61 is installed within the piston 58 via a valve seat envelope 62 so as to be enabled to be open and closed. The discharge valve 61 is housed in the piston 58 and interposed between the valve seat envelope 62 and a spacer envelope 63 so as to be enabled to be moved upwardly and downwardly and is separated from and seated onto the valve seat envelope 62.

A spacer press 64 is spirally secured within the piston. The spacer press 64 serves to position the valve seat envelope 62 via a spacer envelope 63 within the piston 58. Penetrating holes 64A, 64A, — are provided on the spacer press 64 which are communicated with a passage 63A located on the spacer envelope 63. Each penetrating hole 64A serves to communicate the liquefied hydrogen from the passage 63A to a plug 65 (as will be described below).

The plug 65 is spirally attached to an inner periphery of the upper end portion of the piston 58 and encloses the upper end of the piston 58. The plug 65 is provided with a discharge hole 65A obliquely penetrated therein. The discharge hole 65A is connected to a discharge tube 74 (as will be described below). The discharge hole 65A serves to discharge the liquefied hydrogen discharged within the piston 58 via the discharge valve 61 toward an inside of the discharge tube 74.

The piston holder 66 serves as a piston holding member to hold the piston within the pump housing 42. The piston holder 66 is disposed with a clearance within the above-described pump housing 42, as shown in FIG. 2.

The piston holder 66 generally includes: piston securing tubes 67 and 68 each having a stepped cylindrical shape mutually linked in the axial direction of the pump housing 42; a fixing ring 70 whose inner periphery is fixedly secured to an outer periphery of the upper end of the piston 58; and a bottom lid 71 linked to the bottom portion 42A of the pump housing 42 via a second universal joint 72 (as will be described below).

It is noted that a plurality of penetrating holes 71A, 71A, — are formed in the bottom lid 71 so as to be communicated between an outside and inside of the piston holder 66.

It is also noted that an axial displacement of the piston holder 66 is limited within the pump housing 42 via the second universal joint 72 and engagement rod 73 (as will be described below). Even when the cylinder 54 is moved upwardly and downwardly via the connecting rod 51, the piston 58 is axially positioned.

Right and left penetrating holes 70A, 70A are spaced apart from each other which are bent in arc shapes, as shown in FIG. 4, and formed in the fixing ring 70 of the piston holder 66. Each arm 53B of the above-described cylinder holder 53 is inserted through the penetrating hole 70A with a space apart from each other.

Each penetrating hole 70A compensates for the upward and downward reciprocation of the cylinder 54 within the piston fixed tubes 67 and 68.

The second universal Joint 72 is disposed downwardly on the bottom lid 71 of the piston holder 66.

The second universal joint 72 is pivotally interposed between upper Joint rod 72A and lower joint rod 72B via mutually orthogonal pins 72C and 72D.

A lower end of the lower joint rod 72B is fixedly secured to an engagement rod 73.

Figure 5:
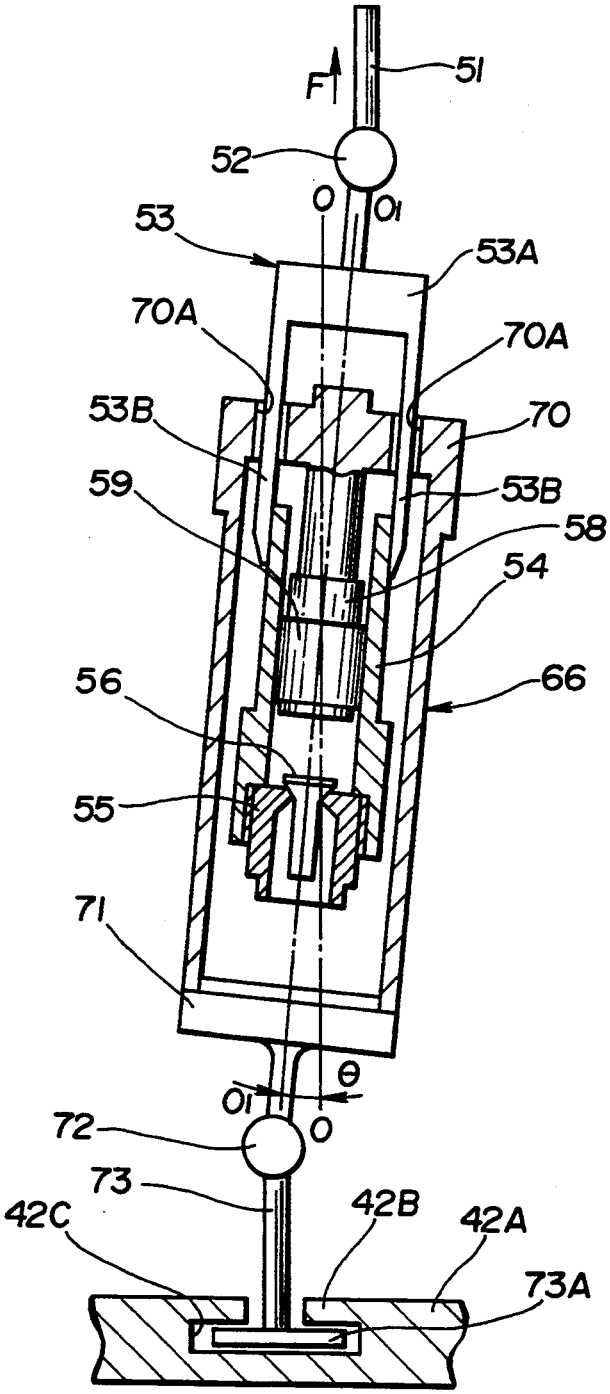
FIG. 5 is an explanatory view of the liquefied hydrogen pump for explaining the automatic axial alignment operation of the liquefied hydrogen pump shown in FIGS. 1 through 4.

The second universal joint 72 permits the piston holder 66 to be inclined in the forward, rearward, rightward and leftward directions with respect to the engagement rod 73 within the pump housing 42 and to be swung with respect to the engagement rod 73 so that both of the cylinder 54 and piston 58 are automatically aligned onto an axial line denoted by 01—01 of FIG. 5 together with the first universal joint 52 located at the cylinder holder 53.

The engagement rod 73 is engaged with the engagement recess 42C of the pump housing 42 and constitutes displacement correction means together with the engagement recess 42C. An alligator portion 73A is integrally attached to the lower end of the engagement rod 73 and is engaged with the step portion 42B of the engagement recess 42C. The alligator portion 73A is of approximately disc shape. It is noted that a radial displacement of the alligator portion 73A is permitted but its axial displacement is limited. The engagement rod 73 permits the piston 58 to be displaced radially within the pump housing 42 via the piston holder 66 and limits the axial displacement of the piston 58 so that a positional deviation of the piston 58 with respect to the cylinder 54 in the radial direction thereof is corrected and the piston 58 is coaxially held within the cylinder 54.

Furthermore, the discharge tube 74 is extended in the axial direction within the pump housing 42. The discharge tube 74 is formed of a small-diameter stainless tube, its lower end being connected to the discharge hole 65A of the plug 65 by means of a silver brazing method.

The discharge tube 74 is connected to a discharge outlet 75 via a joint 76. An upper end of the discharge output 75 is formed on the second mounting flange 45 as shown in FIG. 1 so that the liquefied hydrogen discharged from an inside of the piston 58 is, in turn, discharged toward the discharge outlet 75.

In addition, the discharge outlet 75 is connected to an external discharge tube (not shown) (also called supply tube). It is noted that the external discharge tube is connected to a heat exchanger as described in the BACKGROUND OF THE INVENTION.

Next, an operation of the preferred embodiment described above will be described below.

First, when the external driving source such as the DC motor drives the crankshaft 47 of the pump head 46 to be revolved, the cross head 48 linked to the crankshaft 47 via the connecting rod 49 reciprocates upwardly and downwardly along the liner 50 so that the reciprocating motion of the cross head 48 is transmitted to the cylinder 54 via the elongated connecting rod 51, first universal joint 52, and cylinder holder 53. Therefore, the cylinder 54 reciprocates relatively to the piston 58 within the pump housing 42. Then, the relative reciprocation of the piston 58 and the cylinder 54 causes the liquefied hydrogen within the liquefied hydrogen fuel tank to be sucked into the cylinder 54 via the suction inlet 43, each penetrating hole 71A of the bottom lid 71, and suction valve 56 and the sucked liquefied hydrogen is discharged from the discharge valve 61 within the piston 58 toward the external heat exchanger via the discharge tube 74, the discharge outlet 75 of the second mounting flange 45 under a pressure of, for example, approximately 10 MPa.

On the other hand, since the cylinder 54 is linked to the elongated connecting rod 51 via the cylinder holder 53 within the pump housing 42, the piston 58 being linked to the bottom portion 42A of the pump housing 42 via the piston holder 66, for example, a slide resistance of the piston 58 to the cylinder 54 becomes increased when both piston 58 and cylinder 54 are positionally deviated from their normal positions. Thus, a frictional heat occurs between both of the piston 58 and cylinder 54. Consequently, the liquefied hydrogen to be discharged from the discharge tube 74 becomes easy to be vaporized.

However, in the preferred embodiment, to prevent occurrence of such a disadvantage as described above, the bottom lid 71 of the piston holder 66 is linked to the engagement rod 73 via the first universal joint 72, the alligator portion 73A of the engagement rod 73 is engaged with the bottom portion 42A of the pump housing 42 via the engagement recess 42C, and the piston holder 66 is positioned at the axial direction of the pump housing 42 together with the piston 58 so that both piston 58 and piston holder 66 can be displaced in the radial direction of the pump housing 42.

Thus, even if the piston 58 is radially deviated with respect to the cylinder 54 within the pump housing 42, the piston 58 is moved in the radial direction together with the piston holder 66 when the cylinder 54 is slightly moved upwardly and downwardly within the pump housing 42, so that the positional deviations of the cylinder 58 together with the cylinder 54 in the radial direction of the pump housing 42 can automatically be corrected.

In addition, as shown in FIG. 5, even in a case where the elongated connecting rod 51 is disposed within the pump housing in its inclined state, the lower end of the connecting rod 51 is linked to the cylinder holder 53 via the first universal joint 52 and the bottom lid 71 of the piston holder 66 is linked to the bottom portion 42A of the pump housing 42 via the second universal joint 72. Hence, referring to FIG. 5, both the cylinder 54 and piston 58 can coaxially be disposed on an axial line 01—01 which is inclined by an angle $\theta$ with respect to a center line 0—0 of the pump housing 42. No inclination of the piston with respect to the cylinder is present.

According to the preferred embodiment, when, as shown in FIG. 5, a tensile strength is acted upon the connecting rod 51 in an arrow marked direction F of FIG. 5 so that the liquefied hydrogen sucked into the inside of the cylinder 54 is pressurized by means of the suction valve 56 and piston 58, the above-described piston 58 can be disposed in the automatically aligned state on the axial line 01—01 together with the cylinder 54 and the piston 58 can smoothly be reciprocated with respect to the cylinder 54. In addition, the clearance between the cylinder 54 and the ring 59 of the piston 58 can be minimized so that a leakage of the liquefied hydrogen from both elements of the piston and ring to the external can effectively be prevented.

As described above, in the preferred embodiment, the frictional heat between the cylinder 54 and piston 58 can effectively be suppressed when the liquefied hydrogen is pressurized with the relative reciprocation of the piston within the cylinder 54. Consequently, such a problem as vaporization of the liquefied hydrogen within the cylinder 54 can be avoided.

In addition, the clearance between the ring 59 and cylinder 54 as described above can be minimized, for example, up to about 3. 0 through 3. 5 $\mu$m. An experiment confirmed that an improvement in a discharge efficiency of the liquefied hydrogen could be assured. The experiment also confirmed that a quantity of vaporized hydrogen generated due to the frictional heat between the cylinder 54 and piston 58 could remarkably be reduced and an occurrence of a thermal invasion in the liquefied hydrogen fuel tank could securely be prevented.

Although, in the preferred embodiment, the first and second universal joints 52 and 72 are constituted by joint rods 52A, 52B, 72A, and 72B pin coupled with the pins 52A, 52D, 72C, and 72D, each universal joint may alternatively be constituted by, for example, ball joint type.

Figure 6:
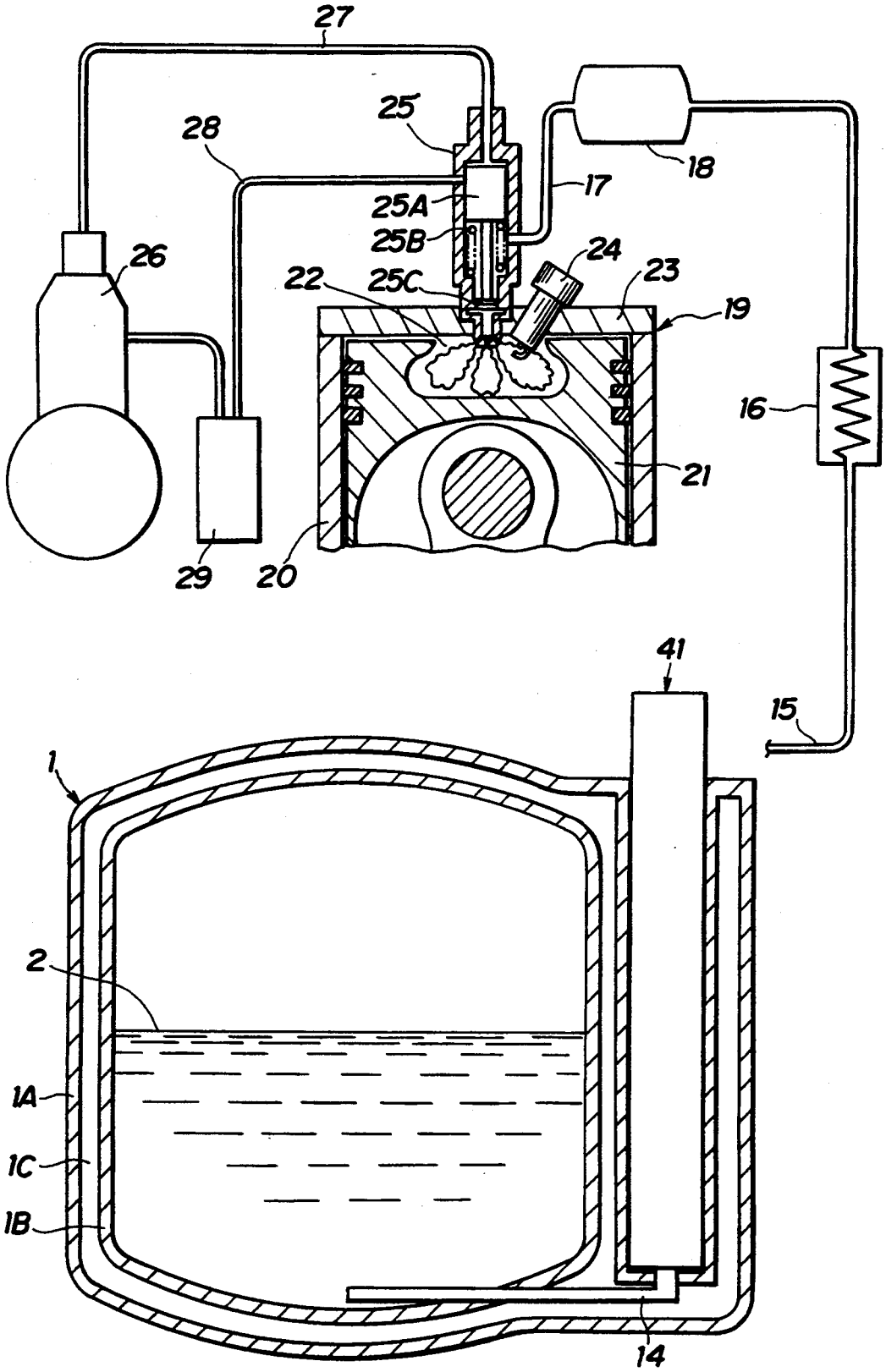
FIG. 6 is an explanatory view of a liquefied hydrogen fuel tank and a hydrogen (ignited) engine to which the preferred embodiment of the liquefied hydrogen pump is applicable.

FIG. 6 shows the liquefied hydrogen fuel tank and the hydrogen (ignited) engine to which the preferred embodiment of the liquefied hydrogen pump 41 is applicable.

In FIG. 6, numeral 1 denotes the liquefied hydrogen fuel tank, numeral 2 denotes liquefied hydrogen, 1A and 1B denote the heat insulating materials constituting double walls of the tank 1, 1C denotes the vacuum layer, numeral 14 denotes the suction tube, numeral 15 denotes the supply tube (external discharge tube), numeral 16 denotes the heat exchanger, numeral 17 denotes the supply tube, numeral 18 denotes the surge tank, numeral 19 denotes the hydrogen engine to be mounted in the automotive vehicle, numeral 20 denotes the cylinder of the engine 19, numeral 21 denotes the piston of the engine 19, numeral 22 denotes the combustion chamber, numeral 23 denotes the cylinder head, numeral 24 denotes the ignition plug, numeral 25 denotes the liquefied hydrogen injection valve, numeral 25A denotes the plunger, numeral 25B denotes the valve spring, numeral 25C denote the valve body, numeral 26 denotes the injection pump, numeral 27 denotes the distribution tube, numeral 28 denotes the distribution tube, and numeral 29 denotes the reservoir. These elements have already been explained in the BACKGROUND OF THE INVENTION.

As described hereinabove, since, in the structure of the liquefied hydrogen pump according to the present invention, the cylinder is linked to the lower end of the elongated connecting rod driven by the pump driving portion via the first universal joint and cylinder holder, the piston slidably fitted into the cylinder is linked to the bottom portion of the pump housing via the piston holder and second universal joint, the radial displacement of the piston holder within the pump housing together with the piston is permitted but its axial displacement thereof is limited, the positional deviations of the cylinder and piston in the radial direction of the pump housing can automatically be corrected and both inclinations can also be corrected. Consequently, the automatic alignment of both of the piston and cylinder to the same axial line can be made.

Thus, when time relative displacement of the piston within the cylinder is carried out to pressurize the liquefied hydrogen, the occurrence of the frictional heat between the cylinder and piston can effectively be prevented and the problem of vaporization of the liquefied hydrogen within the cylinder can be eliminated.

In addition, since the clearance between the cylinder and piston can be minimized, the improvement in the discharge efficiency of the liquefied hydrogen can be assured. Various utilities and advantages can be achieved according to the present invention.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A structure of a liquefied hydrogen pump, comprising;

a) a cylindrical pump housing having a bottom end portion thereof, said bottom end portion having an inlet which is so constructed to suck liquefied hydrogen from a liquefied hydrogen fuel tank into an inside of the pump housing;

b) a pump driving portion located on a top portion of the pump housing and which is so constructed as to be reciprocated by means of an external drive source;

c) an elongated connecting rod, a top end thereof being linked to said pump driving portion, which is extended within said pump housing and along an axial direction of the pump housing;

d) a first universal joint;

e) a cylinder member swingingly linked to a lower end of said connecting rod via said first universal joint and which is so constructed as to reciprocate within said pump housing according to the reciprocating motion of said pump driving portion;

f) a piston member slidably fitted into an inside of said cylinder member and which is so constructed as to make a relative displacement to said cylinder member so that the liquefied hydrogen sucked via said inlet is discharged externally of said pump housing;

g) a second universal joint;

h) a piston holding member, a top end portion thereof being secured to said piston member and a lower end portion thereof being swingingly linked to the bottom end portion of said pump housing via said second universal joint; and i) displacement correcting means for permitting said piston holding member to be displaced toward a radial direction of the pump housing and for limiting said piston holding member to be displaced toward the axial direction of the pump housing.

2. A structure of a liquefied hydrogen pump as set forth in claim 1, wherein said displacement correcting means includes: a stepped engagement recess formed in the bottom end portion of said pump housing; and an engagement rod, a lower end thereof being engaged with said stepped engagement recess so as not to be pulled out of said engagement recess in the axial direction of said pump housing and so as to be enabled to be displaced in the radial direction of the pump housing and an upper end thereof being linked to the lower end of said piston holding member via said second universal joint.

3. A structure of a liquefied hydrogen pump as set forth in claim 2, which further includes a ring enclosing an outer peripheral surface of said piston member, said ring being slidably contacted with said cylinder member, and a ring press spirally secured to the lower end of said piston member so as to press the ring onto the outer peripheral surface of said piston member, said ring being provided so that a clearance between the piston member and cylinder member is minimized.

4. A structure of a liquefied hydrogen pump as set forth in claim 3, wherein said stepped engagement recess formed in the bottom end of said pump housing has an approximately rectangular shaped cross section whose elongated sides are extended in the radial direction of the pump housing, and wherein the lower end of said engagement rod, having an approximately rectangular shape of cross section which is the same as the engagement recess, is received by a step portion of said engagement recess via a hole formed along the axial direction at the bottom end of said pump housing, said hole having a smaller diameter than that of said step portion of said engagement recess, the lower end of said engagement rod having a diameter larger than that of the hole and smaller than that of said step portion of said engagement recess.

5. A structure of a liquefied hydrogen pump as set forth in claim 4, wherein said engagement rod is linked to a bottom lid of said piston holding member via said second universal joint, said bottom lid having a plurality of penetrating holes which serve to communicate the liquefied hydrogen from the inlet with an inside of said piston holding member.

6. A structure of a liquefied hydrogen pump as set forth in claim 5, which further includes a valve seat member having a cylindrical shape and spirally secured to an inner periphery of the lower end of said cylinder member and a suction valve member mounted on said valve seat member so as to be enabled to be opened and closed, said valve seat member having a plurality of penetrating holes around said suction valve member so that when said valve member is open, the liquefied hydrogen present within said piston holding member is caused to flow into an inside of the piston member via said ring press.

7. A structure of a liquefied hydrogen pump as set forth in claim 6, which further includes a discharge valve installed within said piston member via a valve seat envelope secured to said piston member so as to be enabled to be open and closed, said discharge valve being movably housed within said piston member and enabled to move upwardly and downwardly between the valve seat envelope and a spacer envelope and to be separated from and seated on the valve seat envelope and which further includes a spacer press which is so constructed as to piston said valve seat envelope within said piston member via the spacer envelope, said spacer press having a plurality of penetrating holes which serve to communicate to a passage of a spacer envelope.

8. A structure of a liquefied hydrogen pump as set forth in claim 7, wherein each of said penetrating holes formed in said spacer press serves to communicate the liquefied hydrogen from the passage of said spacer envelope to a plug, said plug being spirally secured to an inner periphery of the upper end of said piston member so as to enclose the upper end of said piston member and said plug having a discharge hole connected to a discharge tube, said discharge hole serving to discharge the liquefied hydrogen present within the piston member via said discharge valve toward the discharge tube.

9. A structure of a liquefied hydrogen pump as set forth in claim 8, wherein said piston holding member further includes stepped piston fixing tubes mutually linked in the axial direction of said pump housing so as to movably house said cylinder member said piston fixing tubes being disposed with a space against a wall of said pump housing.

10. A structure of a liquefied hydrogen pump as set forth in claim 9, wherein each of said first and second universal joints include a pair of pins, and wherein said pair of pins are mutually orthogonal to each other.

11. A structure of a liquefied hydrogen pump as set forth in claim 10, wherein said pump housing is disposed within the liquefied hydrogen fuel tank in which the liquefied hydrogen under an extremely low temperature and under a predetermined high pressure is contained.

12. A structure of a liquefied hydrogen pump as set forth in claim 11, wherein said discharge tube is connected to a hydrogen ignited engine via a heat exchanger.

* * * * *